United States Patent [19]

Soler et al.

[11] 4,097,722

[45] Jun. 27, 1978

[54] HAIR BLOWER WITH ORIFICE CONTROL

[75] Inventors: Norman V. Soler, Port Colborne; Richard E. DeSisto, Welland, both of Canada

[73] Assignee: General Signal Corporation, Rochester, N.Y.

[21] Appl. No.: 689,211

[22] Filed: May 24, 1976

[51] Int. Cl.[2] ..... A45D 20/12; B05B 1/12; F24H 3/04

[52] U.S. Cl. ..... 219/368; 15/418; 34/97; 34/243 R; 132/9; 219/370; 219/373; 239/135; 239/455; 239/507; 415/219 R

[58] Field of Search ..... 219/359, 360, 361, 362, 219/364, 366–377, 379–382; 415/219 B, 219 C, 216; 15/322, 415, 418, 419; 34/96–101, 243 R, 90, 91; 239/451, 455, 577, 133–135, 459, 526, 578, 505–508, 511–513; 132/11 R, 9, 112

[56] References Cited

U.S. PATENT DOCUMENTS

| | | | |
|---|---|---|---|
| 578,400 | 3/1897 | Gilmore | 239/455 |
| 1,176,479 | 3/1916 | Morrow | 239/506 |
| 1,272,031 | 7/1918 | Gohmert | 239/455 |
| 1,627,250 | 5/1927 | Parker | 239/455 |
| 1,785,418 | 12/1930 | Meyer | 219/366 X |
| 1,815,535 | 7/1931 | Weitzel | 239/506 |
| 1,846,158 | 2/1932 | Stickley | 219/366 |
| 2,257,342 | 9/1941 | Lintern | 219/368 |
| 2,435,420 | 2/1948 | Beermink | 219/369 |
| 2,827,060 | 3/1958 | Marty | 34/97 |
| 3,003,706 | 10/1961 | Thorne | 239/455 X |
| 3,526,752 | 9/1970 | Bell | 239/368 UX |
| 3,947,659 | 3/1976 | Ono | 219/362 |

FOREIGN PATENT DOCUMENTS

| | | | |
|---|---|---|---|
| 568,043 | 1/1933 | Germany | 34/243 R |

*Primary Examiner*—A. Bartis

*Attorney, Agent, or Firm*—Milton E. Kleinman; George W. Killian

[57] ABSTRACT

A selectively adjustable air deflecting damper is provided in the air exhaust barrel of an electrically heated hand-held hair drier for adjusting the area of the air discharge orifice and concomitantly the air velocity of the heated air discharge. The damper is pivoted in the barrel downstream of the air heating element and is selectively movable between first and second positions providing maximum and minimum effective orifice openings for producing a dispersed and a concentrated air flow, respectively. The damper is spring biased to its first position and operated by a trigger arranged for actuation by a digit of the hand holding the hair drier during use.

8 Claims, 3 Drawing Figures

HAIR BLOWER WITH ORIFICE CONTROL

BACKGROUND OF THE INVENTION

1. Field of the Invention

The present invention provides an improved appliance for drying hair and, more particularly, a hand held hair drying appliance including a heating element, a blower and an air exhaust barrel. Electric hair drying devices are used for drying hair and to facilitate styling or shaping of hair.

2. Discussion of the Prior Art

A wide variety of hair drying appliances have been designed and marketed. Typical design features include an electric heating element and means for controlling the current through the heating element and, thereby, the amount of heat generated. In addition, hair drying appliances include a fan, or impeller, for drawing in external air, passing it over the electrically heated element, and discharging it through an orifice at the end of an air exhaust barrel which is pointed at the area to be dryed, shaped or styled. Features have been provided to control the motor speed and, thereby, control the volume and/or velocity of the air expelled through the orifice.

In using the appliance for drying, styling or shaping of hair, it is desirable to be able to direct the stream of heated air not only in various temperatures and velocities, but also to direct the air stream to either large or confined areas. In typical commercial appliances, attachments have been provided to slip over the open ended barrel and provide a smaller orifice opening in order to direct the flow of heated air to a restricted area. In practice, this has resulted in an inconvenience to the user because in a typical operation, the dryer is held and manipulated by one hand while the other hand is busily engaged in using a comb, brush or retaining the hair. Accordingly, an operator is required to accept either the open end orifice or the attachment with the reduced orifice, irrespective of which is desired at the particular instant. That is, the operator does not have the facility for instantaneously switching from a concentrated air flow to a dispersed air flow without disrupting the styling, shaping or drying operation and placing, or removing, the attachment on the barrel.

SUMMARY OF THE INVENTION

The present invention provides means for controlling the area of the orifice, through which the heated air is expelled, over wide limits and without requiring the manual placement, and/or removal, of a variety of nozzles on the end of the barrel. Within the barrel, a damper, or deflector, is provided for modifying the cross sectional area of the orifice through which the heated air passes. The damper or deflector may comprise an iris similar to that used in cameras. Or, if the barrel is rectangular in cross section, a deflector which is pivoted, or hinged, from one of the walls of the barrel may be provided. In either case, control of the orifice may be had by a linkage to a trigger-like device conveniently located on the hand grip. By this means, the orifice opening may be controlled over wide limits without any interruption in the use of the appliance.

It is an object of the invention to provide a new and improved hand held hair dryer.

It is a more particular object of the invention to provide a new and improved hair dryer which includes means for selectively adjusting the cross sectional area of the port for the heated air stream.

It is another and more particular object of the invention to provide a hand held hair dryer which includes means for adjusting the cross sectional area of the heated air exit port over wide limits.

It is another object of the invention to provide a hair dryer and styler which provides means for adjusting the exit orifice by manual manipulation of a control member on the appliance.

It is another object of the invention to provide a deflector which limits the cross sectional area of the exit port and whose position is selectively controlled through a linkage which may be manipulated while the appliance is in service.

Other objects, advantages and features of the invention will become more apparent as the following description of a preferred embodiment is considered together with the accompanying drawing in which like elements are given like numbers in all views, and wherein FIG. 1. comprises a side view of a typical appliance incorporating the invention and having selected parts cut away to show interior elements;

FIG. 2 comprises an end view; and

FIG. 3 shows the deflector in actuated position.

DESCRIPTION OF THE PREFERRED EMBODIMENT

Figures 1, 2, 3:
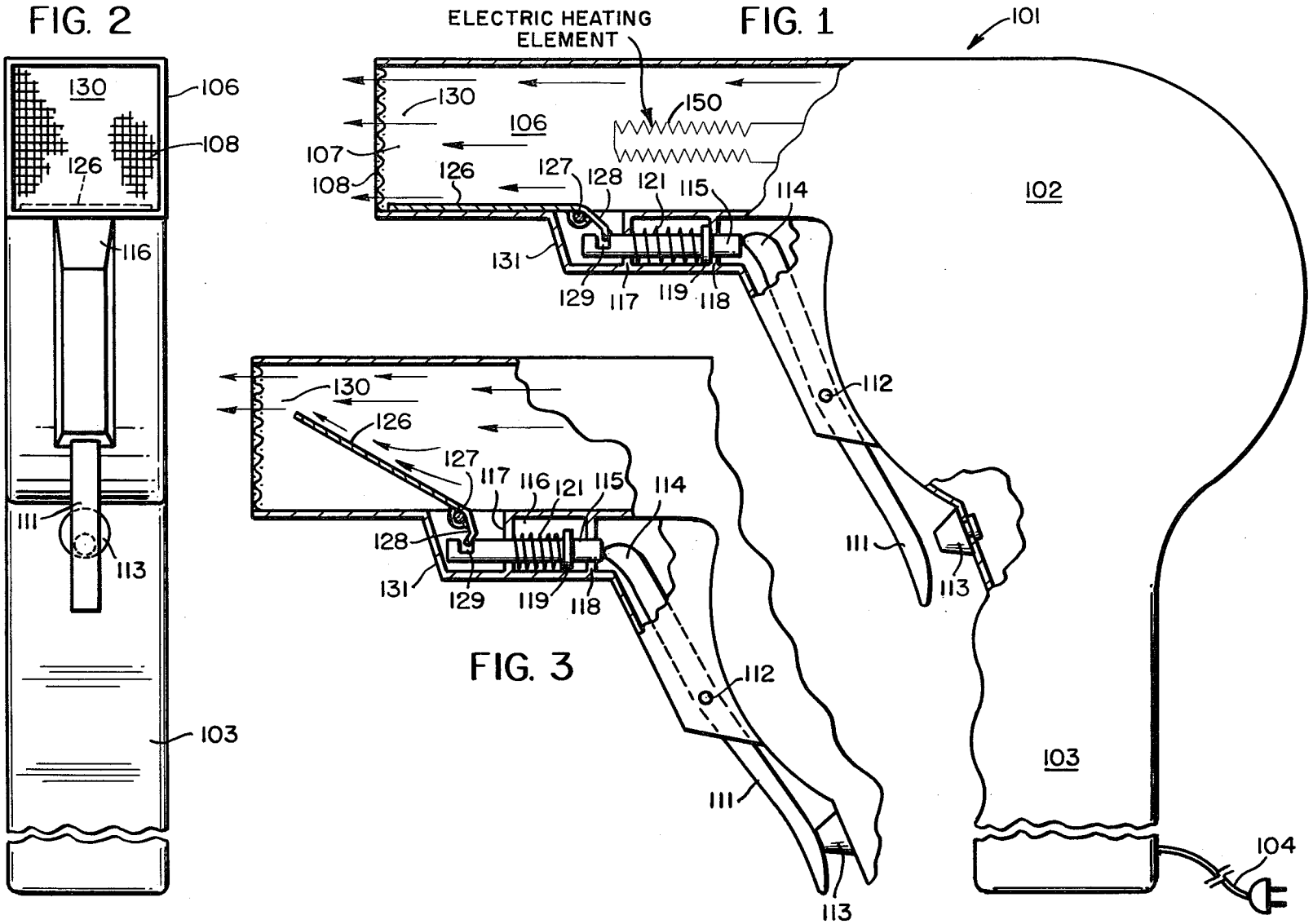

Considering now more specifically FIG. 1, there will be seen in general outline, a hair drying appliance 101 which has incorporated within its housing 102 a motor and electric heater which are not shown in any detail because they are conventional and well known in the art and, therefore, illustration thereof would only tend to complicate the drawing and focus attention away from the novel aspects of the hair drying applicance 101. The appliance 101 includes a conventional hand grip 103 which is conveniently proportioned to facilitate holding the hair drying appliance 101 in a hand. As is conventional, a wire and plug 104 are provided for connecting the appliance to an electrical power source. Room air is brought in through ports 150 heated by the electrical heater (not shown) and propelled by the fan (not shown) to the barrel 106 from which it is discharged through the opening 107. The opening 107 is frequently covered by a wire mesh 108 to prevent the entry of fingers or other undesirable objects into the barrel 106. Typically, appliances of this nature may include one or more switches for controlling the amount of heat dissipated by the heater 150 and/or the fan velocity. These features are common and well known and are not shown herein.

Associated near the hand grip 103 and positioned for convenient actuation by a finger, is a trigger 111 which is pivoted at pivot point 112. Actuation of the trigger 111 will pivot it in a counterclockwise direction about pivot point 112 until the end of the trigger 111 strikes the stop 113. Actuation of the trigger 111 will pivot its remote end 114 and cause it to bear against and move the plunger 115. The plunger 115 is retained within a chamber 116 of the housing 102. The plunger 114 is supported for longitudinal reciprocal motion by walls 117 and 118 within the chamber 116. Formed as an integral part of the plunger 115 is an enlarged member 119 which, as may be seen in FIG. 1, limits the rightward reciprocal motion of the plunger 115 as the member 119 bears on the wall 118. Included within the chamber 116 is a compression spring 121 which bears against the member 119 and the wall 117 to urge the plunger towards the right, as seen in FIGS. 1 and 3, so that the member 119 bears on the wall 118. Because of the contact of the plunger 115 with the end 114 of the trigger 111, the trigger will be biased towards the position shown in FIG. 1. As shown in FIG. 3, manual actuation of the trigger 111 to bring it into contact with the stop 113 will move the plunger 115 to the left against the bias of spring 121.

Within the barrel 106, is a damper 126 which is pivotally mounted at pivot point 127. The damper 126 includes an extension member 128 which extends into the chamber 116 and engages a notch 129 in the plunger 115. Accordingly, the damper 126 and the extension member 128 comprise a bell crank pivoted at pivot point 127. In response to a longitudinal reciprocal motion of the plunger 115, the damper 126 and its extension member 128 will be pivoted about pivot point 127. The damper 126 is shown in its actuated position in FIG. 3; and in its normal position in FIG. 1. As may be seen in FIG. 2, the damper 126 extends the full width of the barrel 106 and, therefore, when the damper 126 is in the position shown in FIG. 3, the air exhausted from the barrel 106 passes through a smaller opening and, therefore, may be directed to a smaller area. Although the volume of air being expelled through the barrel 106 may be slightly reduced when the damper 126 is in the position shown in FIG. 3 the air velocity will be increased. Accordingly, by manual manipulation of the trigger 111, the position of the damper 126 may be adjusted to control the orifice 130 from its full position, as illustrated in FIG. 1, to a restricted opening as shown in FIG. 3. By this convenient expedient, the size of the area to which the heated air is directed may be controlled and also the velocity of the air may be controlled. Since the control may be exercised by manipulation of one of the fingers of the hand grasping and supporting the appliance 101, the control may be exercised while the appliance 101 is in use and without the requirement for the use of the other hand.

It will be evident that if the hair drying appliance 101 is used only in the position shown, that is, with the hand grip 103 in the downward position, the spring 121 could be eliminated and the damper allowed to return to its normal position by the force of gravity.

In the embodiment illustrated, the damper 126 may not be pivoted sufficiently far to completely close the orifice 130. This prevents a total restriction of air flow through the orifice 130 as such total restriction might tend to cause an overheating within the housing 102. If it is desired to provide a total cessation of air flow, the normal procedure would be to actuate a switch which disconnects the flow of current to the heater and/or the fan. If the heater and blower are arranged to be self protecting with a closed orifice 130, the relative position of the trigger 111 and the stop 113 could be adjusted to allow the increased motion of the damper 126 to close the orifice 130.

It will also be apparent that instead of using a plunger 115, the structure could be modified so that the end 114 of the trigger 111 could bear directly on the extension member 128 of the damper 126. If this alternate structure is used and a spring is desired to bias the trigger 111 and the damper 126 to a predetermined position, a spring (not shown) could be inserted between the extension member 128 and the wall 131 of chamber 116.

The structure shown herein requires the use of a rectangular barrel 106. If a barrel having a different shape, such as round, is desired, a damper could be provided which functions like this iris control of a lens. In practice, it is anticipated that an iris-type structure would not be used because of its increased cost over that of a simple damper 126.

While there has been shown and described what is considered at the present to be the preferred embodiment of the invention, modifications thereto will readily occur to those skilled in the related arts. For example, lever ratios might be changed and/or detents added to provide a tactile indication concerning the orifice size. It is believed that no further analysis or description is required and that the foregoing so fully reveals the gist of the present invention that those skilled in the applicable arts can adapt it to meet the exigencies of their specific requirements. It is not desired, therefore, that the invention be limited to the embodiments shown and described, and it is intended to cover in the appended claims all such modifications as fall within the ture spirit and scope of the invention.

What is claimed is:

1. In a hand held electric hair dryer having a barrel provided with an exhaust orifice, an electric heating element disposed in said dryer, a blower for directing a flow of air over said heating element and through said barrel and out of said orifice, and a pistol type hand grip for holding and manipulating the hair dryer to aim the orifice and the flow of heated air in a desired direction, the improvement comprising:

(a) damper means downstream of the heating element and supported in the barrel in the vicinity of the orifice and pivotally movable between first and second positions providing maximum and minimum effective orifice openings for producing a dispersed and concentrated air flow, respectively;

(c) resilient biasing means coupled to said damper means for normally biasing said damper means to said first position for normally providing a maximum effective orifice opening;

(c) trigger means positioned immediately adjacent the pistol type hand grip for selective actuation between first and second limits by a digit of the hand holding said hair dryer by the hand grip during use of the hair dryer; and (d) means coupling said trigger means to said damper for selectively moving said damper against the bias of said biasing means from said first to said second position in response to the movement of said trigger means from said first to said second limit; and wherein (e) the angle formed between said damper means and the barrel wall, on the downstream side of the pivot point of said damper, is acute.

2. The combination as set forth in claim 1, wherein said orifice is rectangular.

3. The combination as set forth in claim 2, wherein said damper means comprises a substantially flat member pivotally coupled to a wall of said rectangular orifice.

4. The combination as set forth in claim 3, wherein said trigger means comprises a pivoted actuator member having one end coupled by said coupling means to an extension of said damper means for pivoting said damper means about its pivot in response to selective pivoting of said pivoted actuator member.

5. The combination as set forth in claim 4, wherein said biasing means normally biases said pivoted actuator member towards said first limit.

6. The combination as set forth in claim 1, wherein said coupling means comprises an actuating link movable between two limits and coupled to said damper means for controlling the position thereof.

7. The combination as set forth in claim 6 and wherein said biasing means biases said link towards one of its two limits.

8. The combination as set forth in claim 7, wherein said biasing means comprises a compression spring acting on said link.

* * * * *